US006837131B2

(12) United States Patent
Bitonto et al.

(10) Patent No.: US 6,837,131 B2
(45) Date of Patent: Jan. 4, 2005

(54) JAR OPENER ASSEMBLY

(75) Inventors: Anthony Di Bitonto, Brooklyn, NY (US); Wilfrido Loor, Brooklyn, NY (US); Kevin Lozeau, Ridge, NY (US); Jeff Brunner, Brooklyn, NY (US)

(73) Assignee: Helen of Troy Limited, Bridgetown (BB)

( * ) Notice: Subject to any disclaimer, the term of this patent is extended or adjusted under 35 U.S.C. 154(b) by 36 days.

(21) Appl. No.: 10/428,877

(22) Filed: May 2, 2003

(65) Prior Publication Data

US 2004/0216561 A1 Nov. 4, 2004

(51) Int. Cl.[7] ..... B67B 7/00
(52) U.S. Cl. ..... 81/3.39; 81/3.09; 81/3.4
(58) Field of Search ..... 81/3.09, 3.36, 81/3.39, 3.4

(56) References Cited

U.S. PATENT DOCUMENTS

| | | | | |
|---|---|---|---|---|
| 1,615,196 A | * | 1/1927 | Lilja | 81/3.39 |
| 1,887,152 A | * | 11/1932 | Geisler | 81/3.4 |
| 2,162,445 A | * | 6/1939 | Richel | 81/3.36 |
| 2,386,460 A | | 10/1945 | Heim | |
| 2,447,770 A | | 8/1948 | Ratchford | |
| 3,999,261 A | * | 12/1976 | Bingaman | 81/3.39 |
| 4,085,632 A | | 4/1978 | Hogan et al. | |
| 4,262,560 A | | 4/1981 | Hofferger | |
| 5,107,727 A | | 4/1992 | Klefbeck | |
| 5,203,236 A | | 4/1993 | Anderson | |
| 5,370,019 A | | 12/1994 | Sartell et al. | |
| 5,943,920 A | | 8/1999 | McGivern et al. | |
| 6,182,534 B1 | | 2/2001 | Hardman | |
| 6,581,497 B1 | * | 6/2003 | Kelton | 81/3.39 |

OTHER PUBLICATIONS

OXO Good Grips Jar Opener, from www.oxo.com/catalog/product (admitted prior art).
OXO Steel Jar Opener, from www.oxo.com/catalog/product (admitted prior art).
Dycem Aids for Daily Living, from www.dycem.com/non-slip/uses (admitted prior art).

* cited by examiner

*Primary Examiner*—James G. Smith
(74) *Attorney, Agent, or Firm*—Seyfarth Shaw LLP

(57) ABSTRACT

The present invention pertains to a jar opener assembly including a torquing tool and a pad which are used in conjunction with each other in order to easily remove a lid from a jar by placing the pad under the jar and attaching the torquing tool so that a cavity having serrated edges abuts against the jar lid in order to apply torque thereto. The torquing tool includes a pad receiving area to which the pad is mounted when not in use.

26 Claims, 5 Drawing Sheets

JAR OPENER ASSEMBLY

The present invention pertains to a kitchen utensil, and in particular, a jar opener assembly having a torquing tool and a pad for use therewith.

BACKGROUND

Jar openers are well known that are formed of a torquing tool having a handle and a lid receiving cavity formed in a V-shape. The V-shaped cavity is formed by edges that engage the outer diameter sides of a lid received therein. One or both of the edges of the V-shaped cavity may have serrations formed thereon in order to engage the outer diameter edges of the lid. Generally, the torquing tool is operated by grasping the handle and wedging the lid into the V-shaped cavity. While the known torquing tools are able to apply a sufficient amount of torque to the lid, such tools are difficult to operate efficiently because upon application of the torque, the jar will rotate, lessening the ability to remove the lid. Although a user's other hand is grasped around the outer diameter of the jar, such gripping force is sometimes insufficient in order to hold the jar against the required torque necessary to unscrew the lid from the jar. The ability to prohibit the rotation of the jar is especially present when the jar is placed on a smooth, low friction countertop or other support surface. There is desired a means of inhibiting the rotation of the jar upon application of torque by the torquing tool. As well, there is desired improvements in the torquing tool in order to provide increased torque against a lid received within a lid receiving cavity.

SUMMARY

The present invention provides for a jar opener assembly for removing a lid from a jar, the assembly comprising a torquing tool including a main body having a first side and a second side, the first side having a lid receiving cavity having at least a pair of edges to apply torque to the lid received therebetween, a second side having a pad receiving area, a handle protruding from the body and a pad removably mounted to the pad receiving area wherein the assembly may be used to open the jar by removing the pad from the main body of the torquing tool and placing it under the jar and placing the torquing tool on the jar so that the lid is received within the lid receiving cavity and torque is applied to the lid and the pad helps to restrict rotation of the jar so that the lid may be more easily rotated and removed from the jar.

In an embodiment, the pad receiving area may include a knob protruding therefrom for receiving an aperture formed in the pad so that the aperture may be press-fit around the knob in order to attach the pad to the pad receiving area. In an embodiment, the pad receiving area may be a generally part-cylindrical recess formed by an annular wall and the pad may have a corresponding generally cylindrically shaped outer diameter and the outer diameter of the pad abuts the annular wall of the recess when the pad is received therein. In an embodiment, the lid receiving cavity may include a first edge having serrations formed thereon. In an embodiment, the lid receiving cavity may include a second edge forming a generally V-shaped cavity with the first edge. In an embodiment, the cavity may include an opening for receiving the lid therethrough. In an embodiment, the serrations may be formed of teeth angled away from the opening. In an embodiment, the first edge may include a first engagement surface forming one half of the V-shaped cavity and a lead-in edge having a second engagement surface. In an embodiment, the first engagement surface may be offset from the second engagement surface forming an angle of 175° or less. In an embodiment, the second edge may include a third engagement surface forming one half of the V-shaped cavity and a lead-in edge having a fourth engagement surface. In an embodiment, the third engagement surface may be offset from the fourth engagement surface forming an angle of 175° or less. In an embodiment, the tool may include a direction of rotation indicia viewable from the first side and second side. In an embodiment, the direction of rotation indicia may be stamped onto the main body portion.

The invention further provides for a jar opener tool for removing a lid screwed to a jar located on a countertop by placing a torquing tool over the lid and applying torque, the tool comprising a pad having a jar bottom abutment area formed of a high friction material, a countertop abutment area opposite the jar bottom abutment area formed of a high friction material and a torsion restriction area formed between the jar bottom abutment area and the counter top abutment area wherein upon application of torque to the lid, the jar rotates counterclockwise imparting a counterclockwise torsion to the jar bottom abutment area of the pad that is transferred to the torsion restriction area that is restricted from rotating by the countertop abutment area that is restricted from rotating due to high friction generated against the countertop so that the jar bottom abutment area restricts the jar from rotating and the lid may be easily removed upon continued application of torque by the torquing tool.

The invention provides also for a method of removing a lid from a jar comprising the steps of providing a torquing tool having a frictional pad attached thereto, removing the pad from the torquing tool, placing the pad on a support surface, placing the jar on the pad, grasping a handle of the torquing tool with a first hand, engaging the torquing tool with the lid so that a working edge of the torquing tool engages the lid edge, grasping the jar with a second hand and applying torque to the lid by rotating the torquing tool in a counter-clockwise direction wherein the pad inhibits rotation of the jar relative to the support surface and allowing easy removal of the lid upon continued application of torque by the torquing tool.

In an embodiment, the pad may be formed of a thermoplastic elastomer. In an embodiment, the pad may include a rim formed at its outer diameter. In an embodiment, the method may further comprise re-attaching of the pad to the torquing tool after the lid is removed. In an embodiment, the method may include re-attachment of the pad by press-fitting an aperture of the pad over a knob protruding from the torquing tool. In an embodiment, the method may further comprise aligning an outer diameter edge of the pad with an inner annular wall of a recess of the torquing tool so that an exposed upper face of the pad is collinear with an exposed upper surface of the torquing tool adjacent the pad.

BRIEF DESCRIPTION OF THE DRAWINGS

For the purpose of facilitating an understanding of the subject matter sought to be protected, there are illustrated in accompanying drawings an embodiment thereof, from an inspection of which, when considered in connection with the following description, the subject matter sought to be protected, its construction and operation and many of its advantages should be readily understood and appreciated.

DETAILED DESCRIPTION OF A PRESENTLY PREFERRED EMBODIMENT

Figure 1:
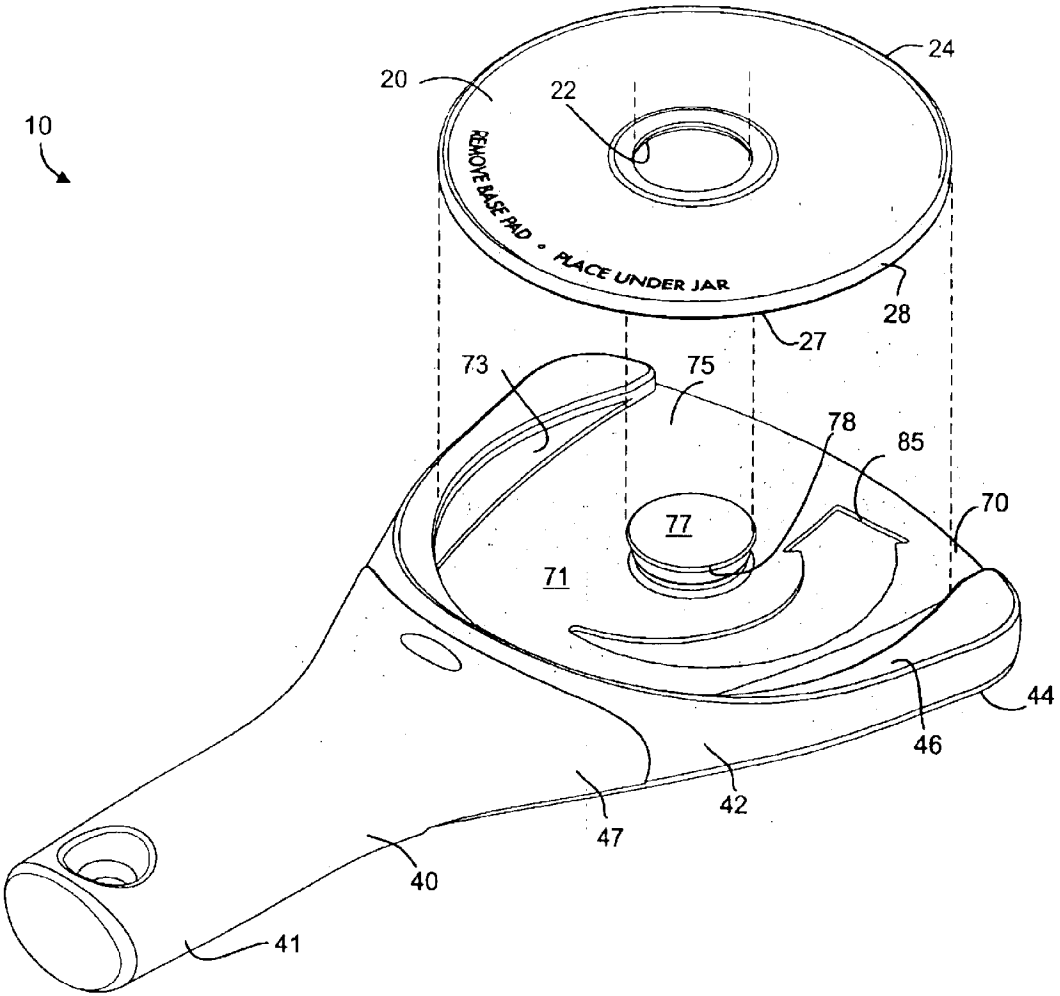
FIG. 1 is an exploded, perspective view of the jar opener assembly of the present invention.
Figure 3:
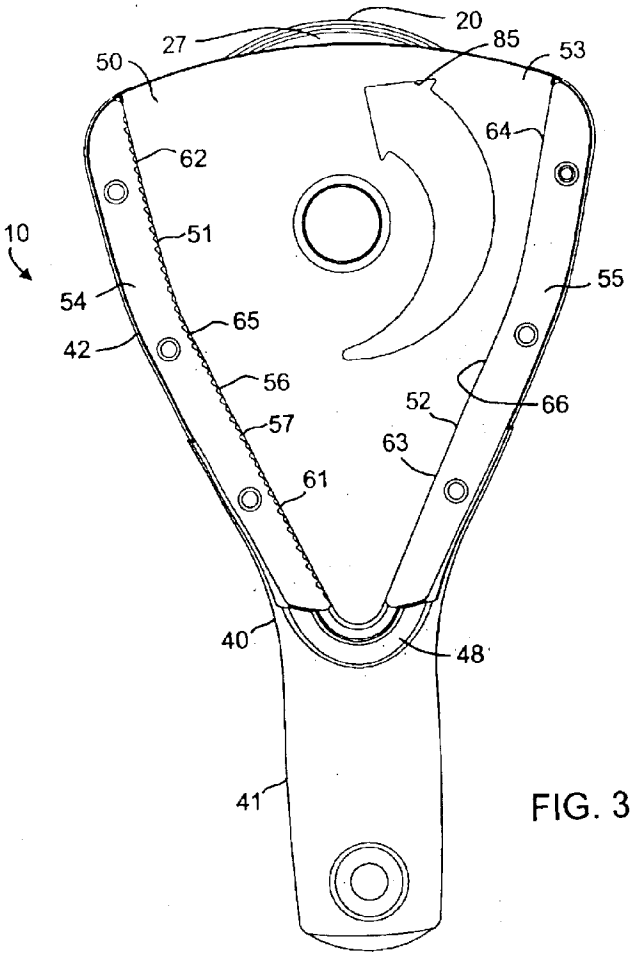
FIG. 3 is a bottom plan view of the jar opener assembly of FIG. 2.
Figure 2:
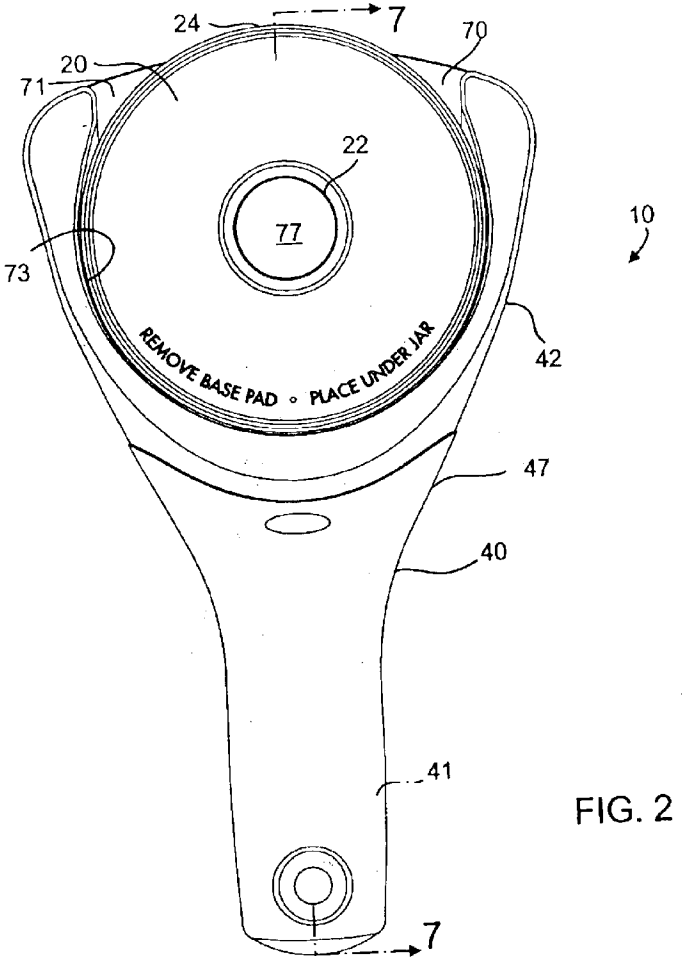
FIG. 2 is a reduced top plan view of the jar opener assembly of FIG. 1.
Figure 4:
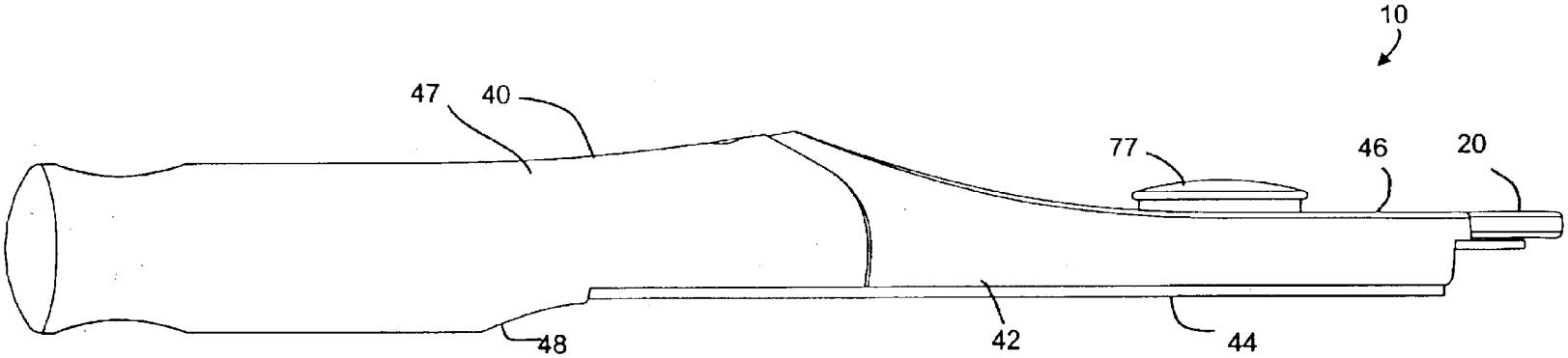
FIG. 4 is an enlarged side elevation view of the jar opener assembly of FIG. 1.
Figure 5:
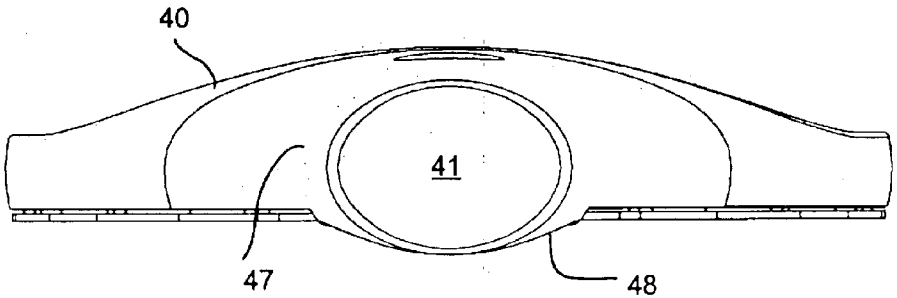
FIG. 5 is an end elevation view of the jar opener assembly of FIG. 4.

An embodiment of the present invention is described with reference to FIGS. 1–7. A jar opener assembly 10 includes a circular pad 20 that includes a central aperture 22 therethrough defining an inner diameter and a rim 24 formed at its outer diameter. The pad 20 in an embodiment is formed of a polymer material, for example, a thermoplastic resin or silicone. The pad forms a jar bottom abutment area 26, a counter top abutment area 27 and a torsion restriction area 28 formed therebetween. The pad 20 acts as a jar opening tool when it is placed under a jar so that the jar bottom abutment area 26 frictionally engages the bottom of a jar 30, and the countertop abutment area 27 frictionally engages a countertop 35 or other horizontal support surface upon which the pad 20 is placed (see FIG. 6). While the main use of the pad 20 is on the bottom of a jar 30, opposite a torquing tool 40, the pad 20 may also be used in certain circumstances on a lid 32 of a jar 30.

The torquing tool 40 includes a handle 41, and extending therefrom, a main body 42, that includes a first side 44 and a second side 46. The handle 41 includes a broad neck 47 that allows a user to "choke-up" on the handle 41 and grip the neck 47 to apply additional leverage to remove the lid 32 from the jar 30. The handle 41 includes a recess 48. In an embodiment the first side forms a lid receiving cavity 50 formed by a first edge 51 and a second edge 52 that form a generally V-shaped cavity 50 that provides a lid engaging mechanism. Opposite the apex of the V-shape is an opening 53, into which the lid 32 of the jar 30 is slid. In an embodiment, the first edge and second edge 51, 52 are working edges formed of metal plates 54, 55 which are attached to the main body 42. In an embodiment the plates 54, 55 of the first and second edge 51, 52 are attached to the main body 42 via fasteners, such as screws. In an embodiment, the main body 42 is formed of a polymer material, such as ABS. In an embodiment the plates 54, 55 are formed of hardened stainless steel. In an embodiment, one of the plates 54 has serrations 56 formed thereon. The serrations in an embodiment, are teeth 57 which are angled away from the opening 53 of the cavity 50. The teeth 57 are uniformly spaced along the length of the first edge 51 in order to engage varying sizes of lids that are received within the cavity 50. However, it is to be understood that in other embodiments the serrations 56 may be placed or formed on the second edge 52, or on both the first and second edges 51, 52.

The cavity 50 provides for a first engagement surface 61, a second engagement surface 62, a third engagement surface 63 and a fourth engagement surface 64. The first and third engagement surfaces 61, 63 form generally a V-shape having an angle of approximately 15 to 65 degrees. The second and fourth engagement surfaces 62, 64 form edges of the cavity 50 which are offset from the first and third engagement surfaces 61, 63, respectively, forming a generally narrower angled V-shape. In other words, the first engagement surface 61 is offset from the second engagement surface 62 by an angle of 175 degrees or less. Likewise, the third engagement surface 63 is offset from the fourth engagement surface 64 by an angle of 175 degrees of less. The second and fourth engagement surfaces 62, 64 provide a lead in edge for initially receiving a lid within the cavity 50. Generally, smaller lids will be received within the cavity so that they are received by the first and third engagement surfaces 61, 63. As such smaller lids will not engage the second and fourth engagement surfaces 62, 64 they will slide deeper into the cavity 40 so that when the lid 32 is wedged into the V-shape of torquing tool 40, the main working surfaces will be the first and third engagement surfaces 61, 63.

Larger lids received by the cavity 50 will be generally engaged by the second and fourth engagement surfaces 62, 64. Due to the larger size, such lids will not slide further than the second and fourth engagement surfaces 62, 64. The narrower angle of the second and fourth engagement surfaces 62, 64 and also arcuate surfaces 65, 66 act on such larger lids in order to provide additional engagement points on the lid 32 in order to increase the torque that may be applied to such lids. The arcuate surface 65 is formed generally between the first engagement surface 61 and the second engagement surface 62. The arcuate surface 66 is formed generally between the third engagement surface 63 and the fourth engagement surface 64. The arcuate surface 65 and second engagement surface 62 maximize the number of teeth 57 that engage a lid 32 received in the cavity 50.

The second side 46 of the torquing tool 40 includes a pad receiving area 70, which is formed by a main body divider 71 and generally annular wall 73. The annular wall 73 forms a part-circular shaped recess 75 which receives the pad 20 therein and provides a storage area for the pad 20. The annular wall 73 has a diameter approximately equal to the outer diameter edge or rim 24 of the pad 20. Protruding from the main body divider 71 is a mounting structure, for example a cylindrical knob 77. The knob 77 includes a rim 78 that has an outer diameter that is approximately equal to or slightly larger than the inner diameter aperture 22 of the pad 20. The knob 77 includes a mounting area 79 that has an outer diameter that is generally less than the inner diameter aperture 22 of the pad 20.

In an embodiment, the attachment of the pad 20 to the torque tool 40 is accomplished by positioning the pad 20 above the pad receiving area 70 and pushing the pad 20 toward the knob 77 so that the knob 77 and aperture 22 are aligned. A friction fit is provided between the rim 78 of the knob 77 and the inner diameter of the aperture 22. Upon further pressure applied to the pad 20, the aperture 22 will flex sufficiently to slide past the rim 78 so that the countertop abutment area 27 of the pad will be flush against the main body divider 71 and the aperture 22 will encircle the mounting area 79 of the knob 77. In this orientation the pad 20 is securely fastened to the torque tool 40 and is stored in the recess 75 until use of the pad 20 is desired.

The torque tool 40 includes direction of rotation indicia 85. In an embodiment, an arrow 85 is stamped to form an opening in the main body divider 71. By having the direction of rotation indicia 85 stamped through the main body divider, 71 it may be viewed from the first side 44 and second side 46 so that the correct direction of rotation of the tool 40 is identified on both sides of the torquing tool 40 during operation. In an embodiment, the handle 41 may be formed of a thermoplastic resin. The tool 10 is assembled, in an embodiment by overmolding a frame 86 formed for example of ABS plastic over an inner core 87 formed of a polymer material, for example, polypropylene (see FIG. 7). The outer surface 88 forming the handle 41 for example, thermoplastic resin, is overmolded on the frame 86. The metal plates 54, 55 that form the first and second edges 51, 52 are attached to the outer surface 88. In an embodiment, a fastener, for example, a screw is used to secure the plates 54, 55 to the tool 10. The main body divider 71 is attached to the tool 10 for example, by fasteners to the inner core 87, frame 86 and outer surface 88, for example having screws (not shown) secured into such layers (see FIG. 7). The main body divider includes a rim 71*a* for receiving the knob 78 and knob base 89 that are snapped in place, in an embodiment.

A preferred method of operating the jar opener assembly 10 will be described. A user's first hand 91 grips the handle 41 of the torque tool 40. The pad 20 is then removed from the torque tool 40 by grabbing the rim 24 with a second hand 92 and pulling the pad 20 up and away from the pad receiving area 70 so that the aperture 22 is slid past the rim 78 of the knob 77, releasing the pad 20 from the recess 75.

Figure 6:
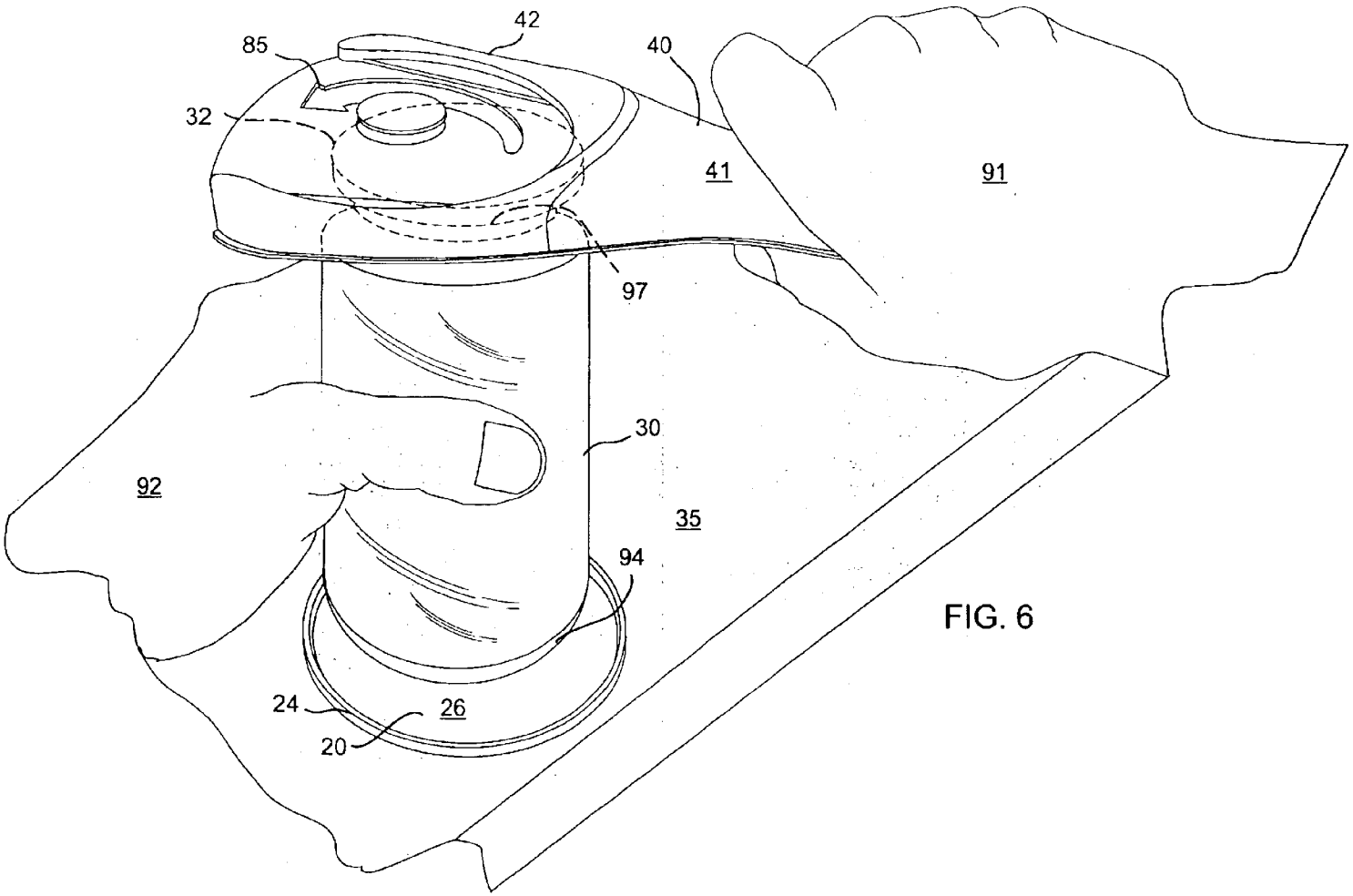
FIG. 6 is a perspective view of the operation of the jar opener assembly.
Figure 7:
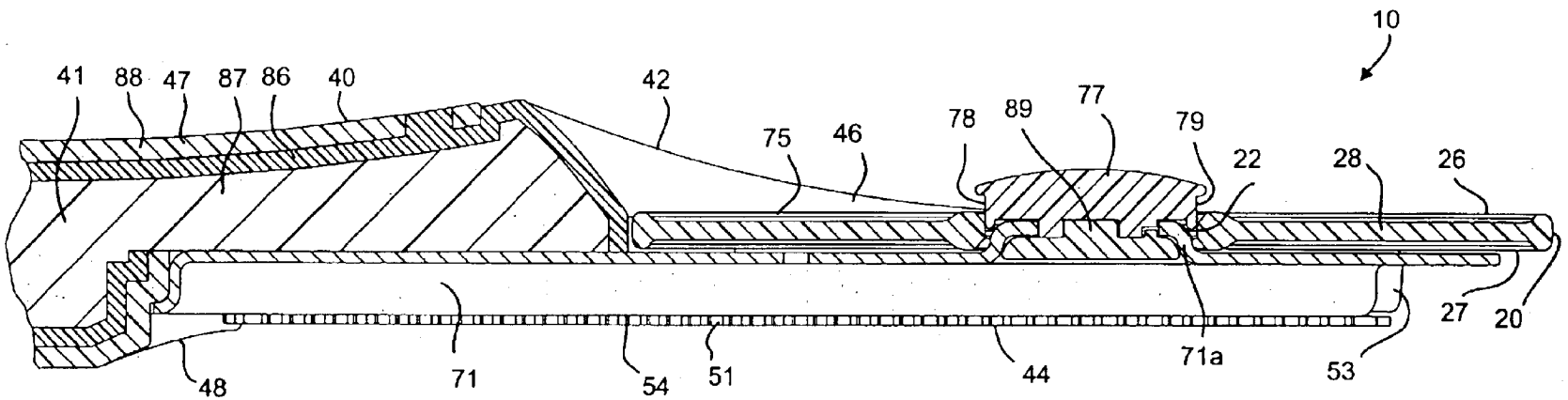
FIG. 7 is an enlarged fragmentary, sectional view taken at line 7—7 of FIG. 2.

Turning to FIG. 6, the rest of the operation of the jar opener assembly 10 will be explained. The pad 20 is then placed on a counter top 35 so that the jar bottom abutment area 26 is facing up and the countertop abutment area 27 is facing down. In an embodiment, the pad 20 may be formed so that these areas 25, 27 are interchangeable. A jar 30 is then placed onto the pad 20 so that the bottom 94 of the jar 30 is abutting the jar bottom abutment area 26 of the pad 20. It is to be understood that any type of vessel having a rotatably mounted and demounted twist-off top may be operated on by the present invention. The torquing tool 40 is then placed over the lid 32 so that the lid 32 is wedged into the receiving cavity 50, and so that the serrated teeth 57 of the first edge 51 and the second edge 52 engage the edge 90 or the outer diameter of the lid 32. The torquing tool 40 is then rotated in a counter clockwise direction as indicated by the direction of rotation indicia 85, imparting torque to the lid 32 and jar 30. The second hand 92 grasps the jar 30 in order to restrict the rotation of the jar 40 in a counterclockwise direction. Both the hand 92 and the pad 20 act in concert in order to restrict such rotation. The jar bottom abutment area 26 is formed of a high friction material, such as silicone, in order to take up the torsion that is applied through the bottom 94 of the jar 30. Such torsion is transferred to the torsion restriction area 28 of the pad 20.

The torsion is applied to the countertop abutment area 27 which is also formed as a high friction material. The countertop 35 will act against the countertop abutment area 27 and will restrict rotation of the pad 20 and transfer the opposite torsional force through the torsion restriction area 28 so that the jar bottom abutment area 26 is maintained in a generally stationary position in order to prevent the rotation of the jar 30 bottom 94 which is restricted by the high friction surface of the jar bottom abutment area 26. Therefore, a large torquing force applied by the first and second edges 51, 52 of the torquing tool 40 may act almost completely against the lid 32 because the jar 30 will remain stationary due to the pad 20.

The matter set forth in the foregoing description and accompanying drawings is offered by way of illustration only, and not as a limitation. All particular embodiments have been shown and described. It will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A jar opener assembly for removing a lid from a jar, the assembly comprising:

a torquing tool including a main body having a first side and a second side, the first side having a lid receiving cavity having at least a pair of edges to apply torque to the lid received therebetween;

a pad receiving area provided on the second side;

a handle protruding from the main body; and a jar-supporting frictional pad removably mounted to the pad receiving area wherein the assembly may be used to open the jar by removing the pad from the main body of the torquing tool and placing it under the jar and placing the torquing tool on the jar so that the lid is received within the lid receiving cavity and torque is applied to the lid and the pad helps to restrict rotation of the jar so that the lid may be more easily rotated and removed from the jar.

2. The assembly of claim 1 further comprising a knob protruding from the pad receiving area and an aperture formed in the pad, so that the aperture may be press-fit around the knob in order to attach the pad to the pad receiving area.

3. The assembly of claim 1 further comprising a generally cylindrical recess formed by an annular wall of the pad receiving area and a generally cylindrically shaped outer diameter of the pad, wherein the outer diameter of the pad abuts the annular wall of the recess when the pad is received therein.

4. The assembly of claim 1 further comprising a first edge having serrations provided by the lid receiving cavity.

5. The assembly of claim 4 further comprising a second edge forming a generally V-shaped cavity with the first edge.

6. The assembly of claim 4 wherein the cavity includes an opening for receiving the lid therethrough.

7. The assembly of claim 4 wherein the serrations are formed of teeth angled away from the opening.

8. The assembly of claim 5 further comprising a first engagement surface forming one half of the V-shaped cavity of the first edge and a lead-in edge having a second engagement surface.

9. The assembly of claim 8 wherein the first engagement surface is offset from the second engagement surface forming an angle of 175° or less.

10. The assembly of claim 9 further comprising a third engagement surface forming one half of the V-shaped cavity of the second edge and a lead-in edge having a fourth engagement surface.

11. The assembly of claim 10 wherein the third engagement surface is offset from the fourth engagement surface forming an angle of 175° or less.

12. The assembly of claim 1 wherein the tool includes a direction of rotation indicia viewable from the first side and second side.

13. The assembly of claim 12 wherein the direction of rotation indicia is stamped onto the main body.

14. The assembly of claim 1 including a broad neck to provide for a handle leverage area.

15. A method of removing a lid from ajar comprising the steps of:

providing a torquing tool having a frictional pad attached thereto;

removing the pad from the torquing tool;

placing the pad on a support surface;

placing the jar on the pad;

grasping a handle of the torquing tool with a first hand;

engaging the torquing tool with the lid;

grasping the jar with a second hand; and applying torque to the lid by rotating the torquing tool, wherein the pad inhibits rotation of the jar relative to the support surface.

16. The method of claim 15 wherein the pad is formed of a high friction thermoplastic resin.

17. The method of claim 15 wherein the pad includes a rim formed at its outer diameter.

18. The method of claim 15 further comprising the step of re-attaching the pad to the torquing tool after the lid is removed.

19. The method of claim 18 wherein re-attachment of the pad is accomplished by press-fitting an aperture of the pad over a knob protruding from the torquing tool.

20. The method of claim 19 further comprising the step of aligning an outer diameter edge of the pad with an annular wall of a recess of the torquing tool so that an exposed upper face of the pad is collinear with an exposed upper surface of the torquing tool adjacent the pad.

21. A jar opener assembly for removing a lid, the assembly comprising:

a torquing tool including a handle;

a lid engaging mechanism connected to the handle;

a pad mounting structure connected to the handle; and a jar supporting frictional pad removably mounted on the pad mounting structure.

22. The assembly of claim 21 wherein the lid engaging mechanism includes a V-shaped cavity formed by a pair of edges to apply torque to the lid.

23. The assembly of claim 21 wherein the pad mounting structure includes a knob to which an aperture of the pad is mounted.

24. The assembly of claim 21 wherein the lid engaging mechanism is provided on a first side of the handle and the pad mounting structure is provided on a second side of the handle.

25. The assembly of claim 21 wherein the torquing tool includes a main body connected to the handle and the pad mounting structure is formed on the main body.

26. The assembly of claim 21 wherein the torquing tool includes a main body having the lid engaging mechanism.

* * * * *